United States Patent [19]

Pallay

[11] 4,174,605

[45] Nov. 20, 1979

[54] METHOD OF AND APPARATUS FOR SPINNING YARN IN AN AIR VORTEX IN A SPINNING TUBE

[75] Inventor: Eduard Pallay, Prague, Czechoslovakia

[73] Assignee: Vyzkumny ustav bavlnarsky, Usti nad Orlici, Czechoslovakia

[21] Appl. No.: 933,991

[22] Filed: Aug. 16, 1978

[30] Foreign Application Priority Data

Aug. 17, 1977 [CS] Czechoslovakia ..... 5393/77

[51] Int. Cl.[2] ..... D01H 1/12

[52] U.S. Cl. ..... 57/58.89; 57/350

[58] Field of Search ..... 57/58.89, 333, 350

[56] References Cited

U.S. PATENT DOCUMENTS

| | | | |
|---|---|---|---|
| 1,500,931 | 7/1924 | Hooper | 57/350 X |
| 3,994,120 | 11/1976 | Radom et al. | 57/58.89 |
| 4,070,812 | 1/1978 | Ostrowski et al. | 57/58.89 |
| 4,077,197 | 3/1978 | Bowden et al. | 57/58.89 X |

FOREIGN PATENT DOCUMENTS

| | | | |
|---|---|---|---|
| 588727 | 12/1959 | Canada | 57/58.89 |
| 880239 | 10/1961 | United Kingdom | 57/58.89 |
| 279383 | 6/1976 | U.S.S.R. | 57/58.89 |

*Primary Examiner*—Donald Watkins

[57] ABSTRACT

Method of and apparatus for spinning yarn of staple fiber in an air vortex in a spinning tube. Separated fibers are withdrawn from the spinning tube in counterdirection to a whirling flow of air produced in a pneumatic chamber coupled to the spinning tube. The yarn being built is twisted in the pneumatic twisting chamber by means of concentric air streaming producing an excited potential air vortex about the longitudinal axis of said pneumatic twisting chamber and about the yarn passing therethrough.

The apparatus is characterized in that a surface of revolution defining the cavity of said chamber is formed by a peripheral surface on which at least one duct opens for supplying pressure air and which merges into lateral surfaces which, beginning from the widest portion of said peripheral surface, converge up to a distance of a gap between an outflow aperture of an outflow tube and an outflow aperture of a yarn take-off tube. Said lateral surfaces are inclined to each other and to the longitudinal axis of said chamber, said inclination producing in the chamber interior a concentric air streaming producing an excited potential air vortex about said longitudinal axis of the chamber.

12 Claims, 9 Drawing Figures

METHOD OF AND APPARATUS FOR SPINNING YARN IN AN AIR VORTEX IN A SPINNING TUBE

The invention relates, on the one hand, to a method of spinning yarn of staple fibers in air vortex in a spinning tube by spinning supplied separated fibers onto a rotating open-end of yarn being withdrawn from the spinning tube in counterdirection to a whirling flow of air produced in a pneumatic chamber coupled to the spinning tube, and, on the other hand, to an apparatus for carrying such method. The apparatus comprises a spinning tube provided with a lateral duct for supplying separated fibers, a pneumatic chamber as a source of whirling air flow into which chamber at least one duct tangentially opens for supply pressure air, and a yarn take-off mechanism, the cavity of said pneumatic chamber being defined by a surface of revolution merging, on the one hand, into an outflow tube communicating with said spinning tube, and, on the other hand, into a coaxial yarn take-off tube the inside diameter of which is smaller than that of said outflow tube.

In known air vortex yarn spinning systems, the vortex necessary for twisting yarn is generated in a pneumatic chamber or in a spinning tube. The yarn is twisted in a loop form in the pneumatic chamber, or helically in the spinning tube. Into the spinning tube there are supplied separated fibers which are continuously spun onto a yarn open end which revolves around the inner wall of the spinning tube. This revolving yarn motion gradually becomes a twisting motion of yarn around its axis; this axial yarn twising motion is transmitted back again to said yarn open-end and thus enables the individual fibers to be spun into the yarn end. The revolving yarn motion in the spinning tube is generated by a rotary air vortex helically flowing in counterdirection to yarn withdrawal from the spinning tube. The air vortex produced in a pneumatic chamber by tangentially impelling air thereinto through one or more ducts is conveyed from the chamber into the spinning tube. The vortex of rotating and simultaneously axially flowing air gives up a part of its kinetic energy to the yarn end revolving predominantly around the inner wall of the spinning tube, said end following a path relatively spaced apart from the tube axis. Consequently, the inside diameter of the spinning tube has to be large enough to allow the yarn revolving motion and to achieve the desired twisting effect.

A disadvantage of such known systems lies in the fact that fibers are spun onto the revolving end of the yarn being built at random and unevenly whereby the properties of the final yarn product are negatively influenced, a substantial portion of fibers not being spun onto the open-end at all and thus going to waste.

Due to the fact that the yarn end revolves together with the air whirling around the inner wall of the spinning tube having a substantially larger diameter than that of the yarn, and that until this revolving motion causes the yarn to axially twist only a portion of the flowing air energy is utilized for the twisting action proper since the air vortex, which does not intimately embrace the yarn, is utilized to a minimum extent and cannot immediately and effectively influence the yarn twisting process. The minimal effect by the air vortex in the yarn twisting process results in a relatively high air consumption per unit of the yarn produced.

Another disadvantage of known air vortex spinning methods is in that the yarn is insufficiently tensioned in the twisting zone and that any endeavor to raise its tension by accelerating the air stream results, in turn, in a higher air consumption. An insufficient tension during the yarn twisting process further leads to a reduction of the final yarn strength since the tension of individual fibers in the yarn body is not uniform.

Moreover, known air vortex spinning systems as a rule require a source of both superatmospheric and subatmospheric air pressure, which factor still negatively influences the power input.

It is an object of the present invention to improve the method of spinning yarn of staple fibers in air vortex leading to a substantial reduction of technological air consumption.

Another object thereof is to provide an apparatus for carrying out this method, which apparatus is simple in construction and reliable in operation.

These and other objects of the invention are substantially attained by a method of spinning yarn of staple fibers in air vortex in a spinning tube by spinning supplied separate fibers onto a rotating open-end of yarn being withdrawn from the spinning tube in counterdirection to a whirling flow of air produced in a pneumatic chamber coupled to the spinning tube, wherein the yarn being built is twisted in the pneumatic twisting chamber by means of concentric air streaming producing an excited potential air vortex about the longitudinal axis of the pneumatic twisting chamber and about the yarn passing therethrough, the twist being transmitted onto the open-end of yarn arising in the spinning tube.

To improve the spinning limit of certain fibrous materials, there is preferred a spinning method wherein, onto the yarn open-end entering a separator attached to the spinning tube, there are spun spinnable fibers which have failed to be processed in the spinning tube, while unspinnable fibers and impurities are separated in the separator and withdrawn by air flow.

For carrying out the method as hereinabove set forth, an apparatus is provided which comprises a spinning tube having a lateral duct for supplying separated fibers, a pneumatic chamber as a source of whirling air flow into which chamber at least one duct tangentially opens for supplying pressure air, and yarn take-off mechanism, the cavity of said pneumatic chamber defined by a surface of revolution merging, on the one hand, into an outflow tube communicating with said spinning tube, and, on the other hand, into a coaxial yarn take-off tube the inside diameter of which is smaller than that of said outflow tube.

The apparatus according to the invention is characterized by the fact that the surface of revolution defining the cavity of the pneumatic twisting chamber is formed by a peripheral surface on which at least one duct opens for supplying the pressure air and which merges into lateral surfaces which, beginning from the widest portion of the peripheral surface, converge up to a distance of a gap between an outflow aperture of the outflow tube and an outflow aperture of the yarn take-off tube, the lateral surfaces being inclined with respect to each other and to the longitudinal axis of the pneumatic twisting chamber, said inclination producing in the interior of the pneumatic twisting chamber a concentric air streaming producing an excited potential air vortex about said longitudinal axis of the pneumatic twisting chamber, which vortex efficiently twists the yarn.

In accordance with a feature of the invention, the mouth of the outflow tube overlaps the edge of the opening through which the lateral duct opens into the spinning tube whereby an effective subatmospheric pressure is produced which positively influences the flow of separated fibers through the lateral duct into the spinning tube.

According to a preferred embodiment of the invention, the lateral duct opens into the spinning tube in the form of a slot preferably parallel with the spinning tube axis. Such embodiment ensures a desirable scattering of the separated fibers to be spun onto the yarn open-end.

Another preferable feature of the invention is that the width of the gap between the two outflow apertures constitutes at most a half of the widest portion of the peripheral surface and the lateral surfaces.

In a preferred embodiment of the pneumatic twisting chamber, from the viewpoint of achievement of an optimum producing effect, the lateral surfaces are so arranged that a component of the concentric air streaming passing through the middle of the gap between the lateral surfaces, upstream of the points in which they enter the outflow apertures of the pneumatic twisting chamber, forms an angle of from 50° to 90° with the longitudinal axis of said chamber. In this way the radial (of the pneumatic twisting chamber) air streaming direction will prevail over the axial one, that is, in the direction of the longitudinal axis of the pneumatic twisting chamber.

The reduction of technological air consumption is also aided by another feature of the invention, which is that the inside diameter of the outflow tube in millimeters equals at most a half of the numerical value of $\sqrt[2]{\text{tex}}$ (tex square root) of the yarn to be spun.

To improve the spinning limit and to enable also less pure fibrous materials to be processed, it is possible to employ an embodiment in which the spinning tube opens into the separator designed for separating impurities and unspinnable fibers from the air flowing out of the spinning tube.

By including the separator in the spinning system, spinnable fibers are prevented from flying off while only unspinnable fibers, dust and impurities are allowed to pass to waste.

The separator is preferably embodied as a basket having a frontal inlet opening attached to the mouth of the spinning tube, an impermeable bottom, and on the periphery a grid made of blades.

Another feature of the invention which increases the effectiveness of the spinning process consists in that a tensioning mechanism is provided between the take-off tube and the pair of take-off rollers for increasing the axial tension in the yarn being built.

To raise the axial tension in the yarn being withdrawn, the yarn tensioning mechanism is formed with two counterdirectionally moving belts which face each other and are designed for rolling the yarn passing therethrough in a direction perpendicular to that of motion of said belts at a velocity approaching, or at most equalling, the yarn twisting velocity in the pneumatic twisting chamber.

An embodiment preferable from the viewpoint of simplicity and operational reliability is characterized in that the belts are runs of an endless belt guided by two guide rolls of which at least one is positively driven, the belt being so arranged that one run is urged toward the other by means of at least one pair of rotary rolls located outside the endless belt.

The apparatus according to the invention requires only a source of pressure air, and the manufacture thereof is not technically demanding and is simple.

The method and apparatus enable the production of yarn of staple fibers at a take-off speed exceeding 150 m.p.m. with a relatively low consumption of technological air and power for each working unit as well as at relatively low prime cost.

Some preferred embodiments of the invention will be hereinafter described in detail with reference to the accompanying, somewhat schematic, drawings which, however, are not intended to limit in any way the scope of the invention.

Figure 1:
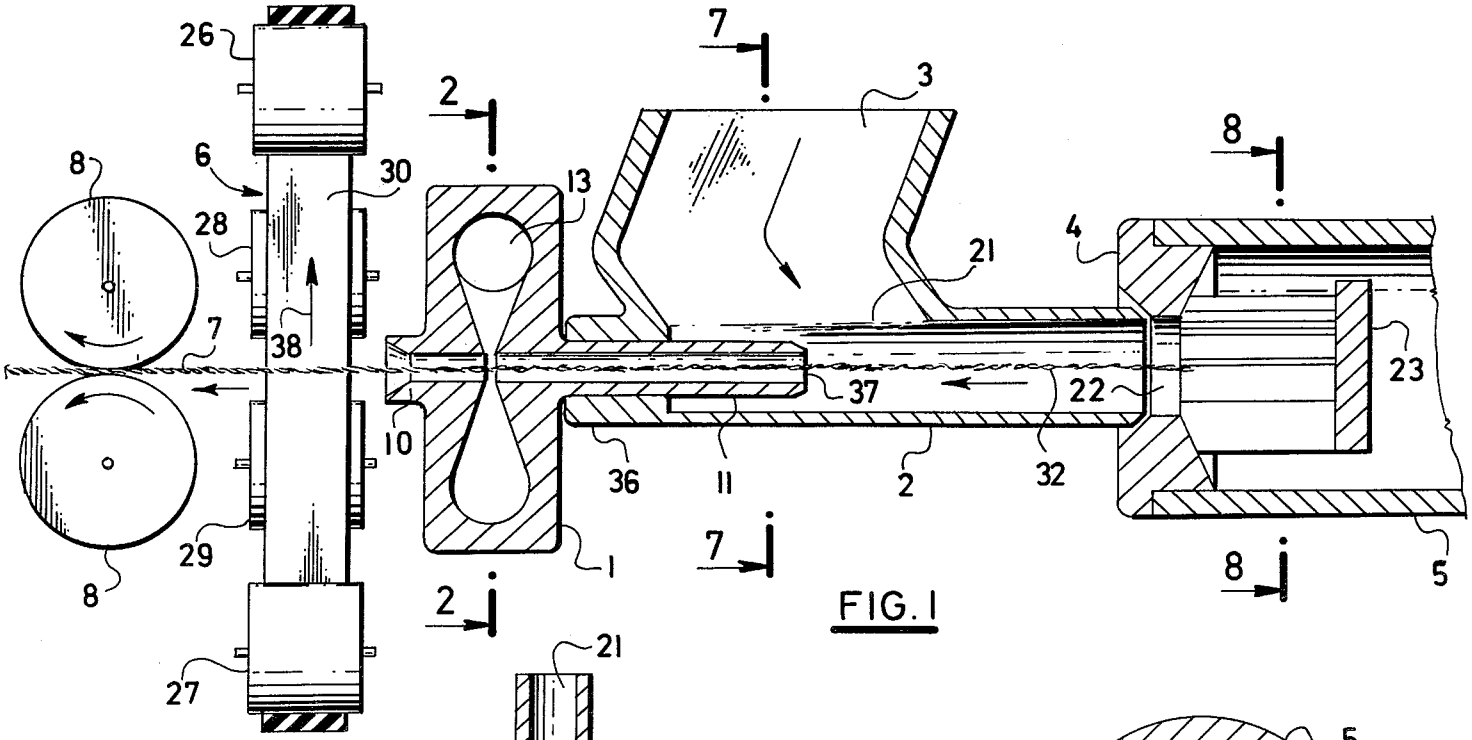
FIG. 1 is an axial vertical sectional view of an air vortex spinning apparatus.
Figure 8:
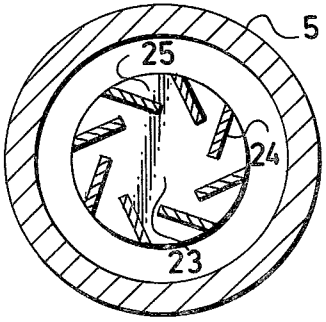
Figure 7:
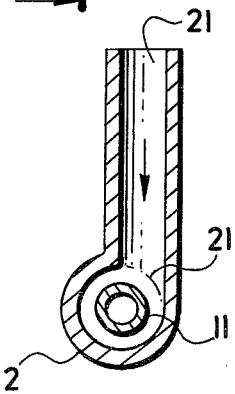
Figure 3:
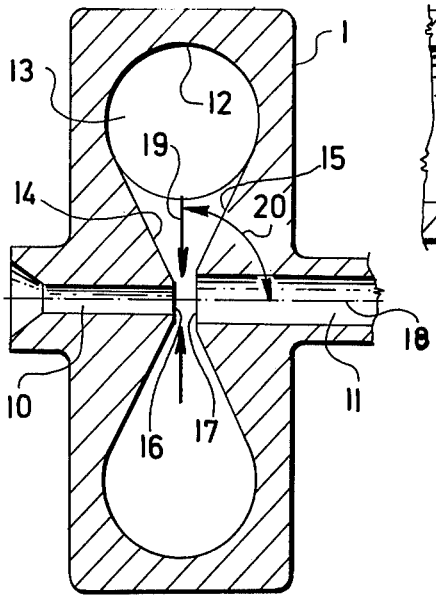
FIG. 3 is an axial vertical sectional view of a pneumatic twisting chamber.
Figure 4:
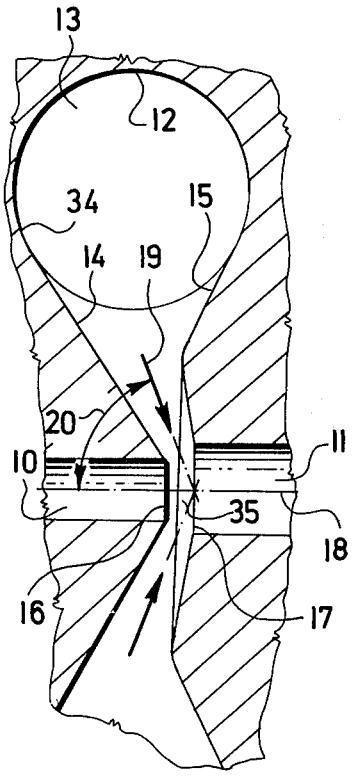
Figure 5:
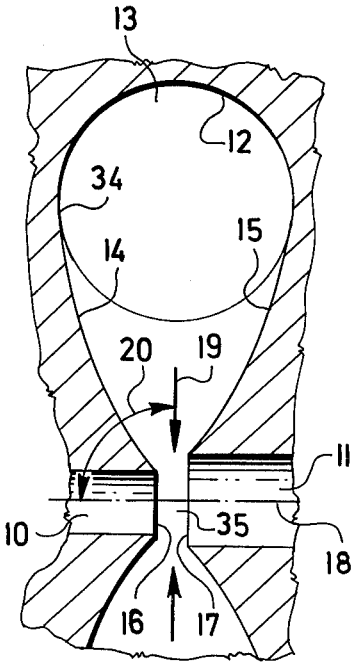
Figure 6:
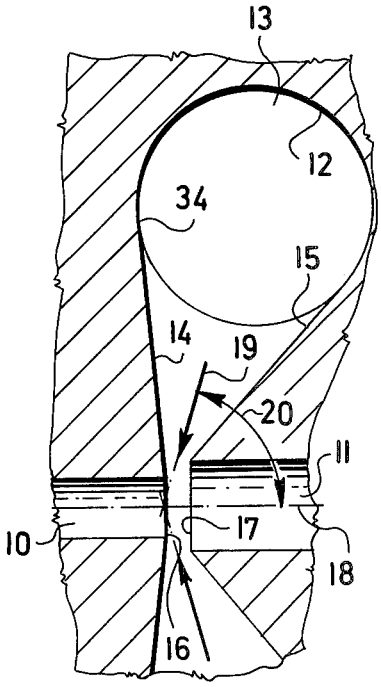

FIGS. 4 to 6, inclusive, are fragmentary views illustrating various embodiments of air twisting chambers in the same manner as in FIG. 3;

FIG. 7 is a sectional view taken along the line 7—7 in FIG. 1;

FIG. 8 is a sectional view taken along the line 8—8 in FIG. 1; and

Figure 9:
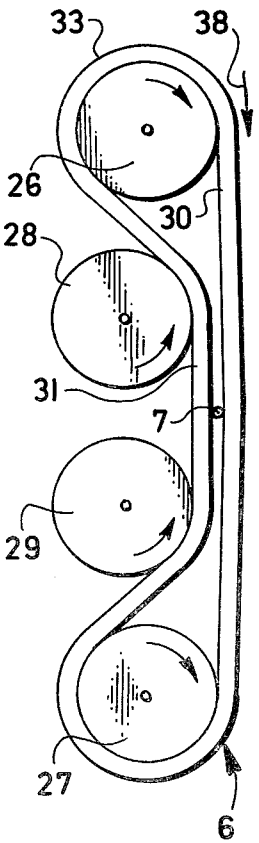

FIG. 9 is a frontal view of the yarn tensioning mechanism shown in FIG. 1.

As can be seen in the drawings, and in particular in FIG. 1 thereof, the air vortex spinning apparatus comprises a stationary pneumatic twisting chamber 1 to which a spinning tube 2 is attached by one of its ends. The spinning tube 2 into which a lateral fiber supplying duct 3 opens, is at its opposite end coupled with a separator 4 received in a partially illustrated tube 5 designed for ejecting air, dust, impurities and fiber fly to waste.

Downstream of the pneumatic twisting chamber 1 (relative to the yarn flow) a yarn tensioning mechanism 6 is disposed, mechanism 6 serving for raising the axial tension in yarn 7 withdrawn from said chamber 1 via said mechanism 6 by a pair of take-off rollers 8, and finally wound onto a bobbin by means of a spooling device (not shown).

The lateral fiber supplying duct 3 communicates with a well-known fiber separating device (not shown) employed, for instance, in open-end rotor spinning systems.

The hollow space of the stationary pneumatic twisting chamber 1 is embodied as a cavity defined by a surface of revolution which merges, on the one hand, into an outflow tube 11 opening into the spinning tube 2, and, on the other hand, into a shorter coaxial yarn take-off tube 10 for withdrawing yarn 7, the inside diameter of tube 10 being smaller than that of the outflow tube 11.

Figure 2:
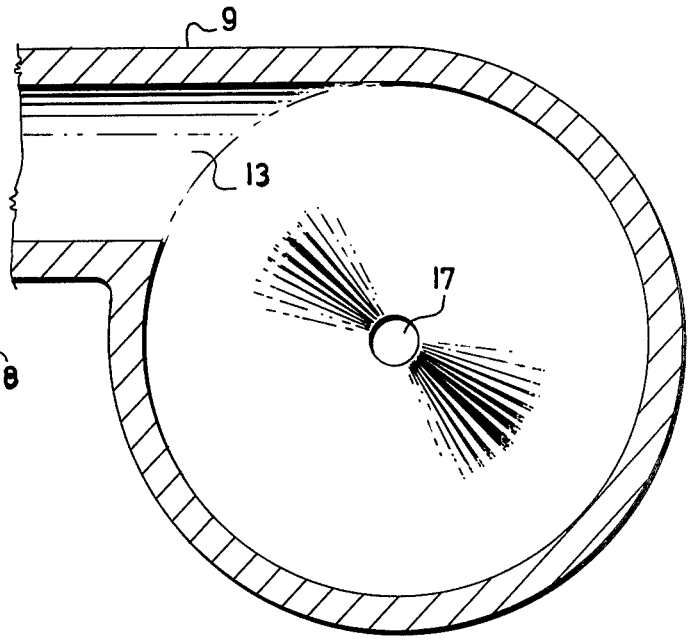
FIG. 2 is a sectional view taken along the line 2—2 in FIG. 1.

The surface of revolution defining the cavity of the pneumatic twisting chamber 1 contains a peripheral surface 12 (FIGS. 3, 4, and 5) which merges into lateral surfaces 14 and 15. An orifice 13 of a duct 9 tangentially opens on the peripheral surface 12, which duct communicates with an unillustrated source of pressure medium (FIG. 2). In the described embodiment, the shape of the orifice 13 corresponds to that of the peripheral surface 12, which means that it is circular. However, its shape can also be elliptic, oval, square, or the like.

Beginning from the widest portion 34 of the peripheral surface 12, the lateral surfaces 14, 15 converge up to a gap 35 between an outflow aperture 17 of the outflow tube 11 and an outflow aperture 16 of the take-off tube 10.

The outflow tube 11 of the pneumatic twisting chamber 1 is fixedly secured in a neck 36 of the spinning tube 2, the mouth 37 of said tube 11 overlapping the edge of the opening 21 through which the lateral duct 3 tangentially opens into the spinning tube 2. In an exemplary embodiment, the mouth 37 extends into tube 2 for a distance up to about one-half of the dimension of the opening 21. The length of the outflow tube portion extending into the spinning tube 2 is chosen so as to give optimum results in spinning the individual fibers onto the rotating yarn open-end.

The pressurized air tangentially supplied into the pneumatic twisting chamber 1 via duct 9 and directed by the peripheral surface 12 and the lateral surfaces 14, 15, flows in the form of concentric streaming, at an ever-increasing velocity, towards the outflow apertures 16, 17 as well as to the longitudinal axis 18 of said chamber 1 wherein it generates a very effective excited potential air vortex around said axis.

In FIGS. 3–6, inclusive, various embodiments of the pneumatic twisting chamber 1 are shown. Preferably, the lateral surfaces 14, 15 should be arranged, relative to the longitudinal axis 18, in such a manner that a component 19 of the concentric air streaming, extending through the middle of the interior of the chamber 1 between the lateral surfaces 14, 15—upstream of the opening of the latter into the outflow apertures 16, 17—includes an angle 20 of from 50° to 90° with the longitudinal axis 18.

As shown in FIGS. 4–6, inclusive, the width of the gap 35 constitutes a fraction of the widest portion of the surface 12 and of the lateral surfaces 14 and 15.

To the end of the spinning tube 2 there is coaxially coupled the separator 4 actually embodied as a cylindrical basket having a frontal inlet aperture 22, an impermeable bottom 23, and on its periphery a grid structure consisting of flat blades 24 (FIG. 8); between said blades 24 there are provided spacings 25 for the withdrawal of air, dust, impurities and fiber fly. Alternatively, the separator 4 can have a conical, frusto-conical, or other shape and can be provided with circular, elliptic or like perforations.

An exemplary embodiment of the yarn tensioning mechanism 6 (FIG. 9) comprises an endless belt 33 encircling two guide rolls 26, 27 of which at least one is positively driven; the two runs 30 and 31 of said belt 33 move in counterdirection and are in close engagement one with the other. The mechanism 6 is driven by an electric motor (not shown) which drives, either via a gearing, or directly, the guide roll 26. The two runs of the endless belt 33 are urged toward each other by a pair of rolls 28, 29 mounted for idle rotation outside the belt 33 on the frame of the working unit (not shown). The direction of movement of the endless belt 33 is indicated by arrow 38. Yarn 7 passing between the runs 30, 31 perpendicularly to the direction of their movement, is rolled, due to the contact with the frictional surfaces of said strands, practically at the same velocity at which the yarn is twisted in the pneumatic twisting chamber 1. Alternatively, the yarn tension mechanism can comprise two endless belts running in counterdirection, the runs of which, facing and forced to each other, constitute frictional surfaces for rolling the yarn therebetween.

The spinning unit according to the invention is arranged, for example, on the housing of a fiber separating device and forms with it an operation unit which is tiltable to and from driving and controlling elements of said spinning unit. By tilting the operating unit from said elements, the air supply, fiber supply to the spinning tube, as well as the drive of the separating device and of the tensioning mechanism 6 are put out of operation.

After the operation unit has been tilted again to said driving and controlling elements, the fiber separating device is first set in operation, and immediately thereafter the pressure air supply, the tensioning mechanism 6 and the supply of fibrous material into the spinning tube 2 are put into operation.

The spinning unit is further provided with a sensor (not shown) designed for monitoring the yarn tension, for instance, within the length between the tensioning mechanism 6 and the take-off rollers 8. In case of a thread breakage, the sensor switches off the fiber-separating device and delivers a light signal. The sensor is here neither described nor shown in detail, since it is a well-known element used in open-end rotor spinning systems.

For carrying out a known spinning-in process when remedying a thread breakage or when starting the spinning unit, the unit with the pneumatic twisting chamber 1 (FIG. 6) is provided, apart from an element for controlling the pressure air supply into the twisting chamber 1, with a pushbutton control for a quick-break of the air pressure supply. For example, the tube 5 together with the separator 4 forms an integral unit which can be uncoupled by displacing it from the spinning tube 2 (FIG. 1).

The spinning-in process can be effected manually, or by semi-automatic or automatic means, the construction of which constitutes no problem for anyone having ordinary skill in the art.

The spinning unit operates as follows:

By supplying pressure air into the duct 9, an excited potential air vortex is generated by a concentric air streaming in the pneumatic twisting chamber 1 about its axis and about the yarn being built and passing therethrough, which vortex in the region of the gap 35 efficiently twists the yarn, the thus-formed twist being transmitted to the open-end 32 of yarn 7.

A predominant portion of the entire air volume supplied into the pneumatic twisting chamber 1 flow in a helical course via outflow tube 11 into the spinning tube 2 in which it keeps the rotating yarn open-end 32 substantially straight. Due to the effect of air vortex ejection in the spinning tube 2, there are sucked in separated fibers via lateral duct 3 from the fiber-separating device, and spun onto the rotating yarn end. A minor air portion flows out to the ambient atmosphere via take-off tube 10. The yarn 7 being built and withdrawn by take-off rollers 8 is caused to pass between the two counterdirectionally advancing runs 30, 31 which effectively stretch and smooth the yarn 7. Finally, the yarn is wound by an unillustrated winding mechanism to form a cross-wound package.

In an exemplary embodiment, the extremity of the spinning tube 2 is attached to the separator 4 into which the open-end 32 of yarn 7 being built extends. Fibers that have failed to be spun in the spinning tube 2 onto the open-end 32 of the yarn 7 being built are carried away together with contained impurities into the separator wherein spinnable fibers are spun into the open yarn end 32 whereas unspinnable fibers together with dust and other impurities are allowed to pass through the spacings 25 between the blades 24 and through the tube 5 to waste.

In general, the excited potential air vortex is produced in the region of the gap 35 between the outflow apertures 16 and 17, which means that it always partially engages, more or less, the cavities of the outflow tube 11 and the take-off tube 10. Thus, for instance, an embodiment of the pneumatic twisting chamber 1 shown in FIG. 4 illustrates that more of the air vortex engages the cavity of the outflow tube 11 than that of the take-off tube 10 while the opposite effect occurs in the embodiment according to FIG. 6. In the former case, the yarn being built is exposed to a higher axial tension which constitutes a positive factor in the spinning process. If, namely, the axial tension is sufficiently high, the yarn tensioning device may even be omitted.

In case of a thread breakage the sensor switches off the supply of fibrous material to the separating device and emits a light signal warning the operator. The operator then tilts the working unit off both driving and controlling elements whereby the air supply into the pneumatic twisting chamber 1, the drive of the fiber-separating device, the drive of the tensioning mechanism 6, and the fiber supply to the spinning tube 2 are cut off. Further, he tilts the cross-wound package off the driving drum, finds the broken yarn end, draws it between the runs 30, 31 of the tensioning mechanism 6 and places the yarn end to the mouth of the take-off tube 10. The operation of the take-off rollers 8 and of the yarn winding mechanism is not interrupted.

By an instantaneous pressure air intake into the pneumatic twisting chamber 1 by depressing a pushbutton, a subatmospheric pressure is produced at the mouth of the take-off tube 10 whereby the sucked-in yarn end is hurled via pneumatic twisting chamber 1 into the spinning tube 2. The operator displaces the separator 4 laterally from the spinning tube 2, pulls a spinning-in reserve yarn length of it through the thus-arisen gap, and severs the faulty yarn end.

The actual spinning-in process is carried out automatically by retilting the working unit back into the operative position; the drive of the fiber-separating device is switched on at first, and then, substantially at the same instant, the pressure air supply is restarted, the package is put into engagement with the driving drum whereby the yarn take-off is restored, and the fiber supply into the spinning tube 2 as well as the drive of the yarn tensioning mechanism 6 are restarted. After the spinning unit has been primed, the operator places the separator 4 aback to the spinning tube 2.

The start of the spinning unit is effected in a similar manner.

The method according to the invention makes it possible to produce yarn at a relatively high take-off speed. Thus, for example, when processing a sliver of cotton fibers of medium staple length, manufactured of American provenience cotton, and when using a fiber-separating device of an open-end rotor spinning unit, it is possible to produce yarn of 25 tex titre at the take-off speed of 200 m.p.m.; the inside diameter of the outflow tube 11 is 1.8 mm and the inside diameter of the take-off tube 10 is 1 mm, the total consumption of pressure air not exceeding 2 $m^3$ per one hour and one spinning unit. The waste is only dust, solid impurities, and short unspinnable fibers of lengths not exceeding 5 mm as a rule.

Although the invention is illustrated and described with reference to a plurality of preferred embodiments thereof, it is to be expressly understood that it is in no way limited to the disclosure of such a plurality of preferred embodiments but is capable of numerous modifications within the scope of the appended claims.

What is claimed is:

1. A method of spinning yarn of staple fibers in air vortex in a spinning tube by spinning supplied separated fibers onto a rotating open-end of yarn being withdrawn from the spinning tube in counterdirection to a whirling flow of air produced in a pneumatic chamber coupled to the spinning tube, comprising twisting the yarn being built in the pneumatic twisting chamber by means of concentric air streaming producing an excited potential air vortex about the longitudinal axis of said pneumatic twisting chamber and about the yarn passing therethrough.

2. A method as claimed in claim 1, wherein onto the yarn open-end entering a separator attached to the spinning tube, there are spun spinnable fibers which have failed to be processed in the spinning tube, while unspinnable fibers and impurities are separated in the separator and withdrawn by air flow.

3. An apparatus for spinning yarn of staple fibers in air vortex, comprising a spinning tube provided with a lateral duct for supplying separated fibers, a pneumatic chamber as a source of whirling air flow into which chamber at least one duct tangentially opens for supplying pressure air, and a yarn take-off mechanism, the cavity of said pneumatic chamber defined by a surface of revolution merging, on the one hand, into an outflow tube communicating with said spinning tube, and, on the other hand, into a coaxial yarn take-off tube the inside diameter of which is smaller than that of said outflow tube, the surface of revolution defining the cavity of the pneumatic twisting chamber being formed by a peripheral surface on which at least one duct opens for supplying the pressure air and which merges into lateral surfaces which, beginning from the widest portion of the peripheral surface, converge up to a distance of a gap between an outflow aperture of the outflow tube and an outflow aperture of the yarn take-off tube, the lateral surfaces being inclined to each other and to the longitudinal axis of the pneumatic twisting chamber, said inclination producing in the interior of the pneumatic twisting chamber a concentric air streaming producing an excited potential air vortex about said longitudinal axis of the pneumatic twisting chamber.

4. An apparatus as claimed in claim 3, wherein the mouth of the outflow tube overlaps the edge of the opening through which the lateral duct opens into the spinning tube.

5. An apparatus as claimed in claim 3, wherein the width of the gap constitutes at most a half of the widest portion of the peripheral surface and the lateral surfaces.

6. An apparatus as claimed in claim 5, wherein the lateral surfaces are so arranged that a component of the concentric air streaming extending through the middle of the gap between the lateral surfaces, upstream of the opening of said surfaces into the outflow apertures of the pneumatic twisting chamber, forms an angle of from 50° to 90° with the longitudinal axis of said chamber.

7. An apparatus as claimed in claim 3, wherein the inside diameter of the outflow tube in millimeters equals at most one-half of the numerical value of $\sqrt[2]{\text{tex}}$ (tex square root) of the yarn to be spun.

8. An apparatus as claimed in claim 3, wherein the spinning tube opens into the separator designed for separating impurities and unspinnable fibers from the air flowing out of the spinning tube.

9. An apparatus as claimed in claim 8, wherein the separator is formed as a basket having a frontal inlet opening attached to the mouth of the spinning tube, an impermeable bottom, and on the periphery a grid made of blades.

10. An apparatus as claimed in claim 3, wherein between the take-off tube and the pair of take-off rollers a tensioning mechanism is provided for increasing the axial tension in the yarn being built.

11. An apparatus as claimed in claim 10, wherein the yarn tensioning mechanism is formed with two counter-directionally moving runs which face each other and are designed for rolling the yarn passing therethrough in a direction perpendicular to that of motion of said runs at a velocity approaching, or at most equalling, the yarn twisting velocity in the pneumatic twisting chamber.

12. An apparatus as claimed in claim 11, wherein the belt runs are runs of an endless belt guided by two guide rolls of which at least one is positively driven, the belt being so arranged that one run is urged toward the other by means of at least one pair of rotary rolls located outside the endless belt.

* * * * *